United States Patent [19]

Chaliha

[11] 4,005,831

[45] Feb. 1, 1977

[54] WIRE TAKE-UP ASSEMBLY

[76] Inventor: Indrajit Chaliha, 5 Mission Row, Calcutta - 1, West Bengal, India

[22] Filed: Nov. 3, 1975

[21] Appl. No.: 628,239

[52] U.S. Cl. ..... 242/82

[51] Int. Cl.[2] ..... B21C 47/00

[58] Field of Search ..... 242/82, 83

[56] References Cited

UNITED STATES PATENTS

| | | | |
|---|---|---|---|
| 2,927,744 | 3/1960 | Nye | 242/82 |
| 2,954,180 | 9/1960 | Crum | 242/83 |
| 2,991,956 | 7/1961 | Bruestle | 242/82 |
| 3,029,039 | 4/1962 | Martinez | 242/82 |

*Primary Examiner*—Edward J. McCarthy

[57] ABSTRACT

This invention concerns a wire take-up assembly of the vertical fixed block type, having a frame provided with a block fixedly mounted thereto, said block having a retaining lip at its open end, a hollow rotatable drive shaft coaxial with the block and guide means for drawing a wire onto the block through the bore of the rotatable shaft and lead-off means for leading away the looped wire helically.

6 Claims, 2 Drawing Figures

WIRE TAKE-UP ASSEMBLY

The present invention relates to a wire take-up assembly of the vertical fixed block type.

Certain drawbacks are known in such existing assemblies. For example, in order to keep a sufficient number of turns of wire on the block it is necessary in known assemblies to use an elaborate arrangement of press rollers and this necessitates a considerable number of moving parts. Thus, the maintenance cost of such an assembly is inordinately high.

The present invention overcomes the aforesaid drawbacks by providing a wire take-up assembly having a frame provided with a block fixedly mounted thereto, the block having a retaining lip at the open end thereof, a hollow rotatable drive shaft coaxially located with respect to the block and guide means being provided for enabling a wire to be drawn through the bore of the rotatable shaft on to the block, and lead-off means for enabling the looped wire to be led away helically.

Preferably, the block comprises an annular body portion having an outwardly extended flange at the upper end thereof for fixed engagement with a support plate forming part of the assembly frame, and bearing blocks oppositely located in the annular body portion for mounting the hollow rotatable shaft.

The guide means may comprise a pair of oppositely extending radial arms having suitable guide rollers mounted thereon.

In a further preferred embodiment of the invention one radial arm is provided with an aperture for leading the wire to be drawn on to the block, and the other radial arm is provided with a niche for engagement with the drawn wire as it falls away helically from the block.

Figure 1:
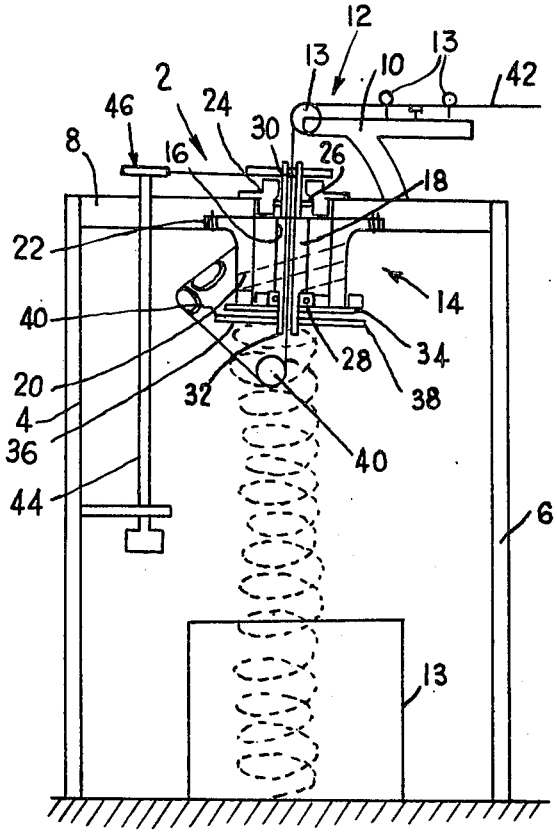
Figure 2:
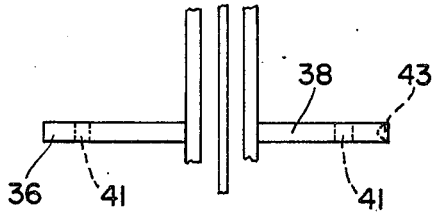

The invention will now be described by way of example with reference to the accompanying drawing, in which FIG. 1 shows a schematic cross-section of the take-up assembly, and FIG. 2 a detail of FIG. 1.

Wire take-up or looping assembly generally denoted as 2 comprises at least a pair of substantially vertical assembly frame columns 4, 6 having a support plate 8 attached to each thereof. Above the support plate 8 is located a guide arm 10 provided with guide means 12 over which the wire may be led; the guide means 12 may comprise rollers or pulleys 13.

Firmly mounted to the support plate 8 is a block generally denoted as 14. The support plate 8 and the block 14 are each provided with a bore 16 through which is rotatably mounted a hollow drive shaft 18. Block 14 is comprised of an annular body portion 20, having an outwardly extending flange 22 at the upper end thereof, which is fixedly engaged to the support plate 8 by bolts or other suitable means. At the upper end of block 14 is mounted a bearing block 24 in which is provided a bearing 26. A like bearing 28 is provided at the lower end of block 14, through which a hollow drive shaft 18 rotates. The hollow drive shaft 18 has stepped portions 30 and 32, and each remote end of these portions rotatably engages bearings 26 and 28, respectively.

At the lower or open end of block 14 is a retaining lip 34, which extends substantially annularly of the block.

A rotor plate 36, 38 is fixedly located on the lower end of the hollow drive shaft 18 and comprises a pair of oppositely extending radial arms 36, 38 for respectively winding and leading off, the wire 42 from the block 14. Mounted on the rotor plate 36, 38 are pulleys 40 for guiding the wire being wound on the block 14. Alternatively, the guide pulleys 40 may be replaced by orifices 41 in the rotor plate itself, and the lead-off rotor arm 38 may be provided with a niche 43.

In operation, the wire 42 is led over guide means 12 and vertically downwards through the hollow drive shaft 18 which is rotated by the main drive shaft 44 through a chain and sprocket, or a gear arrangement generally shown as 46. When the wire 42 has passed through the hollow drive shaft 18, it is led over the pulleys 40 mounted to the lead-on radial arm 36 of the rotor plate, from where it is wrapped around the block 14 a few times to ensure a continuous hawser effect to enable the wire to be pulled. After the turns of wire on the block 14 are sufficient to accommodate the total surface area of the block, the wire under its own weight begins to fall away from the block 14 and the free end engages the radial arm 38. This rotor arm ensures that the looped wire leaving the block 14 will not engage or snag the rotor plate or radial arm 36. This looped wire may then be led away helically to a non-illustrated hopper or conveyor system for further processing.

I claim:

1. A wire take-up assembly comprising a frame provided with a block fixedly mounted thereto, said block having an open end and a retaining lip disposed at said open end, a hollow rotatable drive shaft located coaxially with respect to said block and formed with a bore, guide means for enabling a wire to be drawn through the bore of said rotatable shaft on to said block, and lead-off means for enabling the drawn wire to be led away helically.

2. A wire take-up assembly as claimed in claim 1, wherein said block comprises an annular body portion having an outwardly extended flange at the upper end thereof for fixed engagement with a support plate forming part of the assembly frame, and bearing blocks oppositely located in the annular body portion for mounting the said hollow rotatable shaft.

3. A wire take-up assembly as claimed in claim 1 wherein said guide means comprises a pair of oppositely extending radial arms having guide rollers mounted on at least one of said arms.

4. A wire take-up assembly as claimed in claim 3, wherein one of said radial arms is provided with an aperture for leading the wire to be drawn on to said block, and the other of said radial arms is provided with a niche for engagement with the drawn wire upon the latter falling away helically from said block.

5. A wire take-up assembly as claimed in claim 2, wherein said drive shaft has two remote ends and is provided with a stepped portion at each of said ends for engagement with the bearing blocks.

6. A wire take-up assembly as claimed in claim 2, wherein a guide pulley is provided on said support plate mounted on the assembly frame.

* * * * *